US005401926A

United States Patent [19]

Aoyama et al.

[11] Patent Number: 5,401,926

[45] Date of Patent: Mar. 28, 1995

[54] DATA INPUT DEVICE WITH A MANUALLY OPERABLE KEY HAVING STATIC ELECTRICITY RELEASING FUNCTION

[75] Inventors: Michihiro Aoyama; Yasuo Yatsuda, both of Kawasaki, Japan

[73] Assignee: Fujitsu Limited, Kawasaki, Japan

[21] Appl. No.: 5,571

[22] Filed: Jan. 19, 1993

[30] Foreign Application Priority Data

Jan. 16, 1992 [JP] Japan ..... 4-005625
Jun. 30, 1992 [JP] Japan ..... 4-173104

[51] Int. Cl.[6] ..... G09G 3/02; H05F 3/04

[52] U.S. Cl. ..... 200/305; 341/22; 361/212

[58] Field of Search ..... 345/168; 341/22, 31, 341/34; 200/5 A, 5 R, 341, 517, 304, 305; 361/212, 220

[56] References Cited

U.S. PATENT DOCUMENTS 4,586,106 4/1986 Frazier ..... 361/212
4,678,880 7/1987 Kazumi et al. ..... 200/305
4,814,566 3/1989 Sigt ..... 200/305
5,120,923 6/1992 Kato et al. ..... 200/517
5,130,506 7/1992 Zuercher et al. ..... 220/5 A
5,335,137 8/1994 English et al. ..... 361/212

FOREIGN PATENT DOCUMENTS 59-62699 4/1984 Japan .
60-97420 5/1985 Japan .
1319218 12/1989 Japan ..... 200/329

OTHER PUBLICATIONS

"Test Methods for Visual Display Units", MPR 1990:8 1990 Dec. 1.

*Primary Examiner*—Alvin E. Oberley
*Assistant Examiner*—Amare Mengistu
*Attorney, Agent, or Firm*—Staas & Halsey

[57] ABSTRACT

A data input device, such as a keyboard, comprising at least one key having a static electricity releasing circuit incorporated therein. The key comprises a manually operable keytop for pushing the membrane switch and is made from an electrically conductive plastic. At least one coil spring is provided between the keytop and the support panel or the other conductive layer that is connected to a ground. Thus a static electricity releasing circuit is formed from the keytop to the ground via the coil spring so as to instantaneously and reliably release static electricity that has accumulated on an operator to a ground.

23 Claims, 8 Drawing Sheets

DATA INPUT DEVICE WITH A MANUALLY OPERABLE KEY HAVING STATIC ELECTRICITY RELEASING FUNCTION

BACKGROUND OF THE INVENTION

1. Field of the Invention

The present invention relates to a data input device such as a keyboard having the function of releasing accumulated static electricity on a human body.

2. Description of the Related Art

With the recent development of data processing apparatuses, keyboards are increasingly used as data input devices for transferring data between people and machines. Keyboards have multiple data input keys that are operated by hand to input data represented on the keys into the machine.

Static electricity frequently accumulates on an operator and, when an operator with static electricity accumulated thereon touches a keyboard, a discharge occurs between the operator and the keytop and a noise is produced in an electric circuit in the keyboard or in the computer, and if the noise is large, the computer may work incorrectly or stop. Accordingly, there is an arrangement such that a portion of the keyboard that is assumed to be first touched by an operator is connected to a ground so as to release static electricity to a ground when the operator touches that portion.

For example, Japanese Unexamined Utility Model Publication (Kokai) No. 59-62699 discloses an electronic device having a switch, in which a portion of the switch assumed to be touched by an operator is made from an electrically conductive material and a metal piece is provided so as to slidably engage with a movable portion of the switch with the metal piece connected to a ground via resistance.

Also, Japanese Unexamined Patent Publication (Kokai) No. 60-97420 discloses a keyboard in which a keytop is made from an electrically conductive material that is connected to a ground by a conductor wire. Also, in a modification in this reference, a stationary key holder facing the movable keytop is connected to a ground so that the keytop is brought into contact with the key holder so as to release static electricity to the ground when the keytop is operated.

Also, a recent Japanese patent application filed by the assignee of this application proposes a keyboard having a link displaceably connecting a keytop with respect to a support panel, in which the keytop is electrically connected to the support panel via the link so as to release static electricity to a ground via the support panel.

In this way, it is possible to release static electricity to the ground, by connecting a portion of the keyboard that is to be touched by the operator to the ground. However, there are problems in the above described prior arts. In the prior art stipulating that the keytop of the keyboard be directly connected to the conductor wire, there are problems in the wiring and the key operating facility. In the prior art stipulating that the keytop of the keyboard is slidably engaged by the metal piece that is not a fundamental element of the key, there are problems in the key operating facility and there is bad electrical contact between these elements, thereby making it impossible to release static electricity. Also, in the prior art stipulating that the keytop be brought into contact with the key holder when the keytop is operated, it is impossible to release static electricity reliably because it is not certain that the keytop contacts the key holder when an operator touches the keytop lightly.

When static electricity accumulated on a person is released to the ground, a discharge current flows. If the discharge current is too high, the operator experiences an electric shock. Accordingly, it is necessary to arrange a resistance between the keytop and the ground for controlling the discharge current at an appropriate value. In this case, when the resistance is too high, it is impossible to properly release static electricity. Accordingly, the Sweden ESD Standard, for example, stipulates that resistance in the static electricity releasing circuit between the keytop and the ground be within a range from 10 to 500 MΩ.

SUMMARY OF THE INVENTION

The object of the present invention is to provide a data input device in which static electricity can be released to the ground by using a method that is simple and reliable.

Another object of the present invention is to provide a data input device in which resistance in a static electricity releasing circuit between a keytop and a ground can be appropriately arranged.

According to the present invention, there is provided a data input device comprising a support panel and at least one key mounted on the support panel, said key comprising a switch element arranged on the support panel, a manually operable keytop for turning the switch element on and off, and at least one coil spring biasing the keytop away from the support panel, wherein at least a part of the keytop is made from an electrically conductive material, and the coil spring has one end brought in contact with said at least a part of the keytop and the other end being connected to a ground.

With this arrangement, the coil spring normally contacts the keytop and thus a static electricity releasing circuit is formed from the keytop to the ground via the coil spring. Accordingly, when an operator touches the keytop, static electricity accumulated on the operator instantaneously and reliably flows to the ground. The coil spring functions as a return spring to bias the keytop away from the support panel, thereby ensuring that there is no incongruous feeling when operating the key.

When the switch element comprises a membrane switch, one preferred embodiment of forming the static electricity releasing circuit comprises a membrane switch that has an aperture for passing the coil spring therethrough, whereby one end of the coil spring contacts the keytop and the other end of the coil spring contacts the support panel. The support panel is normally connected to a ground for electromagnetic shielding.

When the switch element comprises a membrane switch, another preferred embodiment of forming the static electricity releasing circuit comprises a membrane switch that has a wiring means for the static electricity releasing circuit, whereby one end of the coil spring contacts the keytop and the other end of the coil spring contacts the wiring means of the membrane switch. The wiring means of the membrane switch is connected to a ground.

At least a part of the keytop is made from an electrically conductive material such as a metal or an electrically conductive plastic. The electrically conductive plastic comprises a resin material and minute electrically conductive particles mixed in the resin material. The electrically conductive plastic is preferable since it is possible to control the resistance in the range from several tens KΩ to several hundreds MΩ by a mixing ratio of the minute electrically conductive particles in the resin material. Therefore, if the keytop is made from an electrically conductive plastic, it is possible to provide a desired resistance to the static electricity releasing circuit by the keytop itself. That is, in this case, the keytop is made from an electrically conductive plastic having a high resistance in the range from 10 to 500 MΩ.

However, in the electrically conductive plastic having a high resistance, when the minute electrically conductive particles are not uniformly distributed in the resin material, the resistance value may vary from position to position. To avoid a variation in the resistance value, it is preferable that the keytop be made from an electrically conductive plastic having a low resistance smaller than 1 MΩ. In this case, a resistor having a high resistance in the range from 10 to 500 MΩ is arranged between the support panel and a ground, and it is possible to arrange the resistor at a desired location.

BRIEF DESCRIPTION OF THE DRAWINGS

The present invention will become more apparent from the following description of the preferred embodiments, with reference to the accompanying drawings, in which.

DESCRIPTION OF THE PREFERRED EMBODIMENTS

Figure 1:
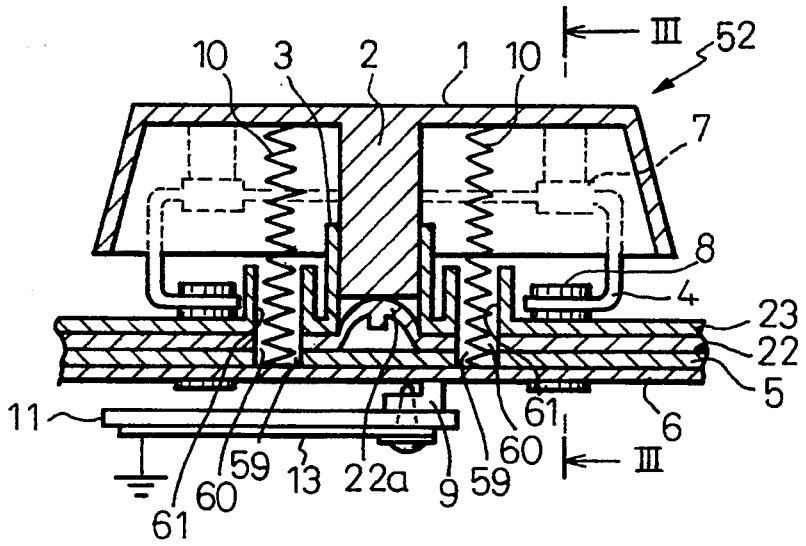
FIG. 1 is a cross-sectional view of a part of a keyboard according to the first embodiment of the present invention.

FIG. 1 is a cross-sectional view of the first embodiment of the present invention, illustrating a key 52 of a data input device.

Figure 5:
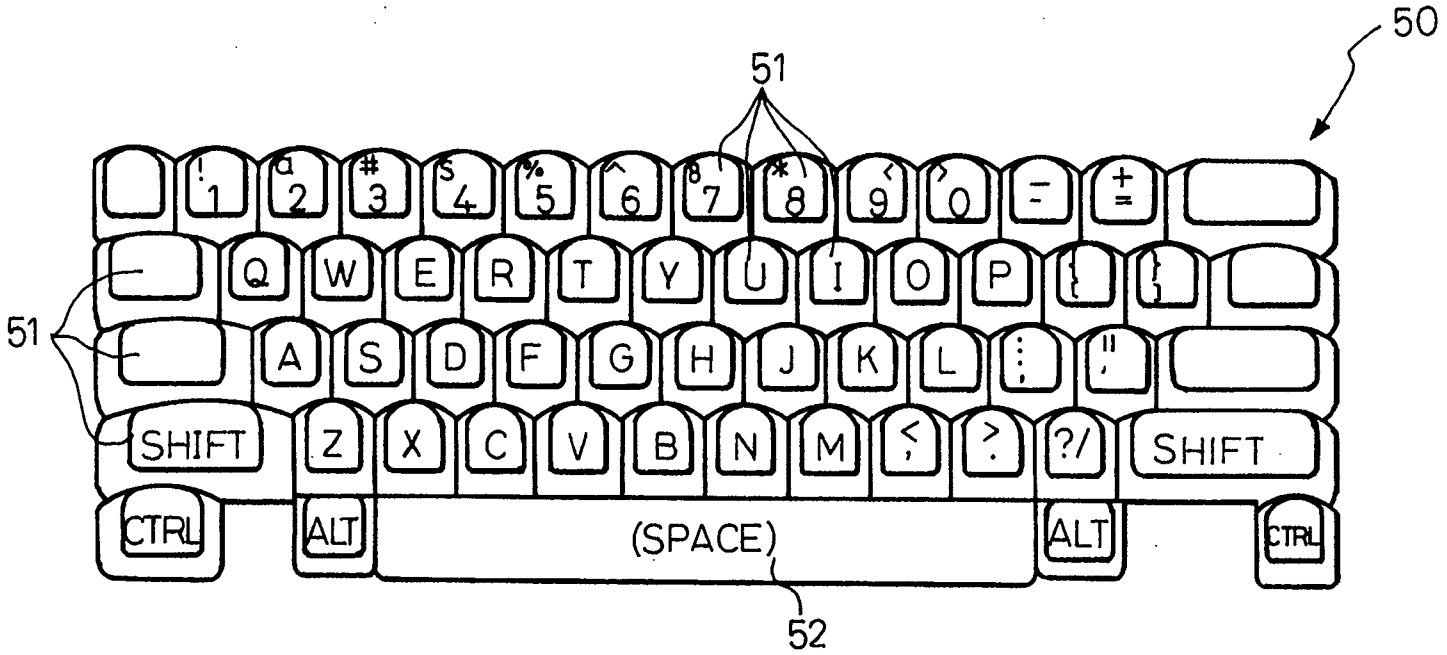
FIG. 5 is a plan view of an example of a keyboard.

FIG. 5 shows a keyboard 50 as the data input device that has a plurality of character keys 51 such as letter keys, numeral keys, and control keys, and a space key 52. The space key 52 is the largest and is used most frequently, and thus is located at such a position that it is most convenient to operate. Usually, the space key 52 is operated first, and for this reason, a static electricity releasing circuit is incorporated into the space key 52, according to the present invention.

In FIG. 1, the space key 52 comprises a manually operable keytop 1, a slider 2 connected to the under side of the keytop 1, and a membrane switch 5 as a switch element turned on and off by the slider 2. The keyboard includes a metal support panel 6 and the membrane switch 5 is secured to the upper surface of the support panel 6. In addition, a rubber actuator 22 is arranged on the membrane switch 5, and a switch panel 23 is arranged above the rubber actuator 22. The switch panel 23 is mounted on the support panel 6 and has a housing 3 for slidably guiding the slider 2. This arrangement is common to the other keys 51.

Figure 4:
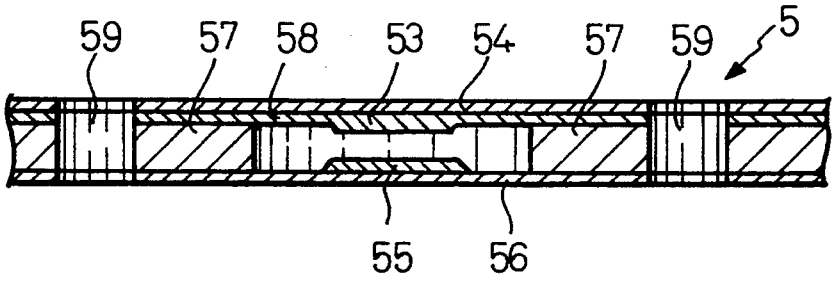
FIG. 4 is an enlarged cross-sectional view of the membrane switch of FIG. 1.

As shown in FIG. 4, the membrane switch 5 comprises a first resin layer 54 having contacts 53 (only one shown in FIG. 4) at positions corresponding to the keys 51 and 52, a second resin layer 56 having contacts 55 (only one shown in FIG. 4) arranged corresponding to the contacts 53 of the first resin layer 54, and a spacer 57 arranged between the first and second resin layers 54 and 56, as is well known in the art. The contacts 53 of the first resin layer 54 are connected to, for example, a wiring pattern 58 extending from the right to the left in FIG. 4, and the contacts 55 of the second resin layer 56 are connected to a wiring pattern (not shown) extending perpendicular to the plane of the sheet of FIG. 4. These wiring patterns are connected to a control wiring board.

The contacts 53 and 55 of FIG. 4 are located below the slider 2 of the keytop 1 of the space key 52 of FIG. 1. The membrane switch 5 (and thus the first and second resin layers 54 and 56 and the spacer 57) has apertures 59 on either side of the contacts 53 and 55, and these apertures 59 allow coil springs 10, described later, to pass therethrough.

During the operation of the membrane switch 5, when the slider 2 with the keytop 1 is operated downwards, the slider 2 depresses the upper contact 53 so that the upper contact 53 contacts the lower contact 55, which is a turning-on action of the switch. Actually, there is an inverted cup shaped member **22*a* of the rubber actuator 22 between the slider 2 and the membrane switch 5, as shown in FIG. 1, and the slider pushes the membrane switch 5 via the inverted cup shaped member 22*a*. The inverted cup shaped member 22*a* has elasticity so as to lift the slider 2 when the finger is disengaged from the keytop 1. It is possible to arrange a spring in the housing 3, instead of the rubber actuator 22**.

In the embodiment of FIG. 1, two coil springs 10 are arranged on either side of the slider 2 of the keytop 1. The membrane switch 5 has two apertures 59, as described above, and the rubber actuator 22 and the switch panel 23 have apertures 60 and 61 at the same positions as the apertures 59, respectively. Accordingly, one of the respective ends of the coil springs 10 contacts the keytop 1 and the other respective ends of the coil springs 10 contact the support panel 6. The support panel 6 is connected to a ground electrode 13 of a wiring circuit board 11 by a metal member 9. This wiring circuit board 11 is, for example, a wiring circuit board for controlling the keyboard. In this way, a static electricity releasing circuit is formed from the keytop 1 to the ground electrode 13 via the coil springs 10 and the support panel 6. Accordingly, when an operator touches the keytop 1, static electricity that has accumulated on the operator instantaneously and reliably flows to the ground.

For this purpose, the entire keytop 1 or a part of the keytop 1 abutting against the coil springs 10 is made from an electrically conductive material such as a metal or an electrically conductive plastic. The electrically conductive plastic comprises an ABS resin and minute electrically conductive particles such as aluminum, silver, or carbon mixed in the ABS resin. The electrically conductive plastic is preferable since it is possible to control the resistance in the range from several tens KΩ to several hundreds MΩ by a mixing ratio of the minute electrically conductive particles in the resin material.

In the embodiment of FIG. 1, the keytop 1 is made from an electrically conductive plastic having a high resistance in the range from 10 to 500 MΩ. The Sweden ESD Standard provides that resistance in the static electricity releasing circuit between the keytop 1 and the ground be within a range from 10 to 500 MΩ, and the resistance of the keytop 1 satisfies this standard.

Figure 3:
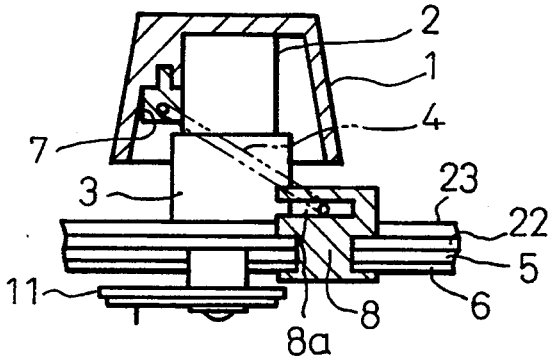
FIG. 3 is a cross-sectional view of the keyboard of FIG. 1 taken along the line III—III in FIG. 1.

In FIGS. 1 and 3, the space key 52 includes an elongated generally C-shaped link 4 interconnecting the keytop 1 and the support panel 6 for relative movement therebetween. The keytop 1 has a bearing 7 for rotatably supporting a stem portion of the link 4 and the support panel 6 has link holders 8 having slots 8*a* for slidably receiving the end portions of the link 4. Thus, when the keytop 1 moves upward and downward, the movement of the keytop 1 is controlled while the stem portion of the link 4 rotates in the bearing 7 and the end portions of the link 4 slide in the slots 8*a*. That is, when one of the ends of the large keytop 1 is operated, the entire keytop 1 moves parallel to the support panel 6.

Figure 2:
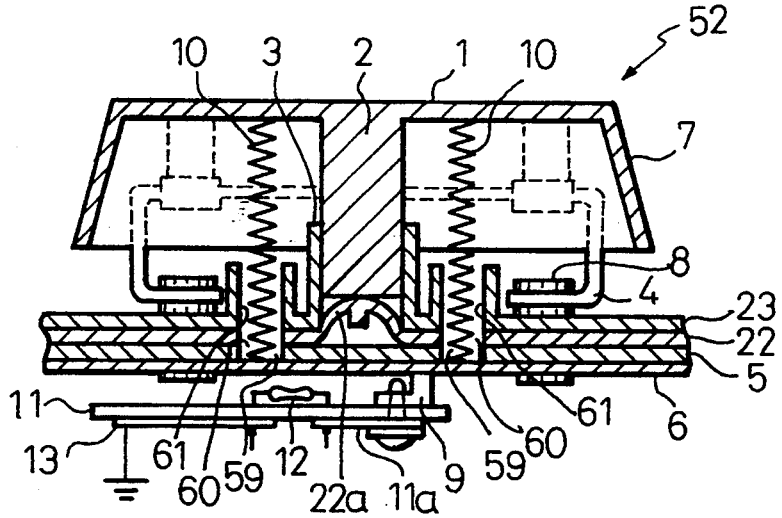
FIG. 2 is a cross-sectional view of a part of a keyboard according to the second embodiment of the present invention.

FIG. 2 is a cross-sectional view of the second embodiment of the present invention, illustrating a key 52 of a data input device.

In FIG. 2, the space key 52, similar to the previous embodiment, comprises a manually operable keytop 1, a slider 2 connected to the under side of the keytop 1, and a membrane switch 5. The membrane switch 5 is secured to the upper surface of the support panel 6. A rubber actuator 22 is arranged on the membrane switch 5, and a switch panel 23 is arranged above the rubber actuator 22. The switch panel 23 is mounted on the support panel 6 and has a housing 3 for slidably guiding the slider 2. A link 4 is arranged to interconnect the keytop 1 to the support panel 6.

In FIG. 2, two coil springs 10 are arranged on either side of the slider 2 of the keytop 1. The membrane switch 5 has two apertures 59, and the rubber actuator 22 and the switch panel 23 have apertures 60 and 61 at the same positions as the apertures 59, respectively. Accordingly, one of the respective ends of the coil springs 10 contacts the keytop 1 and the respective other ends of the coil springs 10 contact the support panel 6. The support panel 6 is connected to a electrode 11*a* of a wiring circuit board 11 by a metal fitting 9 and the electrode 11*a* is connected to a ground electrode 13 via a resistor 12. In this way, a static electricity releasing circuit is formed from the keytop 1 to the ground electrode 13 via the coil springs 10 and the support panel 6. Accordingly, when an operator touches the keytop 1, static electricity that has accumulated on the operator instantaneously and reliably flows to the ground.

In this embodiment and the other embodiments, the keytop 1 is made from an electrically conductive plastic. However, in the electrically conductive plastic, when the minute electrically conductive particles are not uniformly distributed in the resin material, the resistance value may vary from position to position. If the resistance value varies from position to position, a resistance value of the static electricity releasing circuit varies depending on positions at which the coil springs 10 contact the keytop 1, which occurs particularly when the keytop 1 is made from an electrically conductive plastic having a high resistance.

In the embodiment of FIG. 2, the keytop 1 is made from an electrically conductive plastic having a low resistance smaller than 1 MΩ, and the resistor 12 having a high resistance in the range from 10 to 500 MΩ is arranged in series with the keytop 1. Therefore, this static electricity releasing circuit does not suffer during a variation of the resistance and satisfies the Sweden ESD Standard.

In general, an electrically conductive plastic is more expensive than non-conductive plastic, and according to the present invention, only the keytop 1 is made from an electrically conductive plastic and the other resin components are made from a cheap non-conductive plastic. The coil springs 10 are made from metal.

Figure 6A:
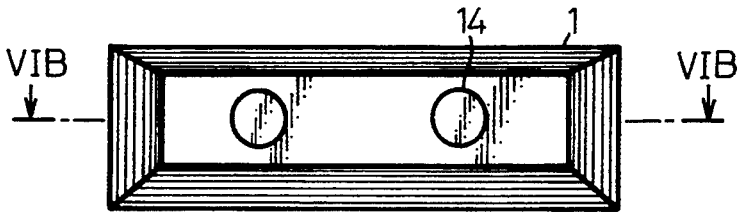
FIG. 6A is a plan view of a keytop according to the third embodiment of the present invention.
Figure 6B:
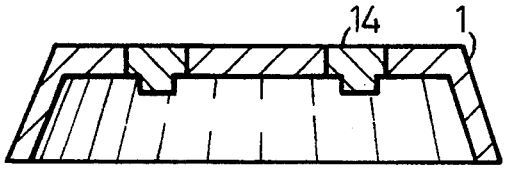
FIG. 6B is a cross-sectional view of the keytop of FIG. 6A taken along the line VIB—VIB in FIG. 6A.

FIG. 6A is a plan view of a keytop 1 according to the third embodiment of the present invention and FIG. 6B is a cross-sectional view of the keytop 1 of FIG. 6A taken along the line VIB—VIB in FIG. 6A. Only the keytop 1 is shown but lit will be understood that this keytop 1 can be used in the keyboard of FIGS. 1 and 2. The keytop 1 includes portions 14 made from an electrically conductive plastic and the remaining portion is made from a cheap non-conductive plastic. The portions 14 extend from the upper surface of the keytop to the lower surface thereof and are arranged so that the coil springs 10 abut against the portions 14. This arrangement serves to reduce the amount of expensive electrically conductive plastic to be used. It is also possible to make the portions 14 from metal.

Figure 7:
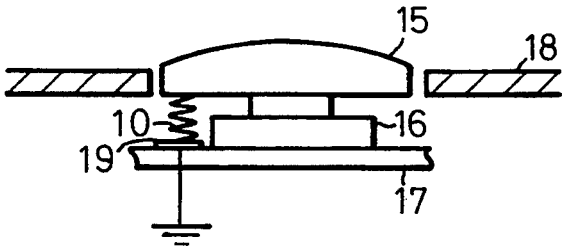
FIG. 7 is a cross-sectional view of a data input device according to the fourth embodiment of the present invention.

FIG. 7 is a cross-sectional view of a data input device according to the fourth embodiment of the present invention. This embodiment is an example of a small key switch as a data input device using a simple push button switch 16, instead of the membrane switch 5. The key switch comprises a switch button or a keytop 15, and a push button switch 16 mounted on a wiring circuit board 17. The keytop 15 projects from a cover 18. The keytop 15 is made from an electrically conductive plastic and connected to a ground electrode 19 by a coil spring 10. In this embodiment, it is possible to release static electricity through the static electricity releasing circuit from the keytop 15 to the ground electrode 19 via the coil spring 10. This key switch is small and can be used in, for example, a mouse having a static electricity releasing circuit.

Figure 8:
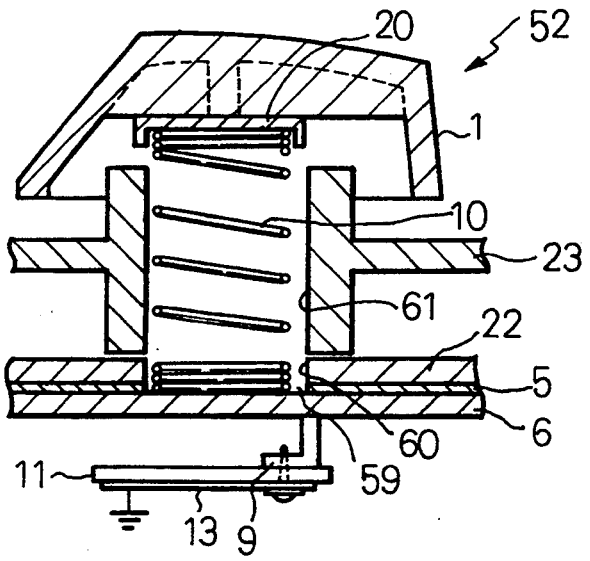
FIG. 8 is a cross-sectional view of a part of a keyboard according to the fifth embodiment of the present invention.

FIG. 8 shows the fifth embodiment of the present invention, illustrating a space key 52 similar to that of FIGS. 1 and 2. FIG. 8 is a cross-sectional view of the key 52, corresponding to, for example, a cross-sectional view in FIG. 1 passing through only the coil spring 10 of FIG. 1. Thus, the slider 2 and the housing 3 of FIG. 1 are not shown in FIG. 8.

In FIG. 8, the membrane switch 5, the rubber actuator 22 and the switch panel 23 have apertures 59, 60 and 61, respectively. Accordingly, one end of the coil spring 10 contacts the keytop 1 and the other end of the coil spring 10 contacts the support panel 6. Also, a metal cap 20 is arranged between the keytop 1 and the coil spring 10 so that a contact area between the metal cap 20 and the keytop 1 is broader than a contact area between the metal cap 20 and the coil spring 10. Accordingly, even when the resistance varies from position to position in the keytop 1 made from an electrically conductive plastic, it is possible to ensure an electrical connection between the keytop 1 and the coil spring 10.

Figure 9:
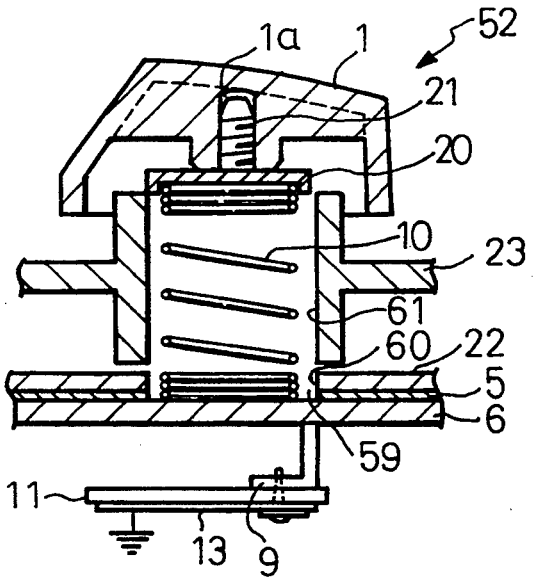
FIG. 9 is a cross-sectional view of a part of a keyboard according to the sixth embodiment of the present invention.

FIG. 9 is a cross-sectional view showing the sixth embodiment of the present invention, corresponding to FIG. 8. In FIG. 9, the metal cap 20 has a threaded portion 21 that is threadably engaged in a threaded hole 1*a* provided in the keytop 1. By this arrangement, it is possible to increase the contact area and the contact pressure between keytop 1 and the metal cap 20 and thus to ensure an electrical connection between the keytop 1 and the coil spring 10.

Figure 10:
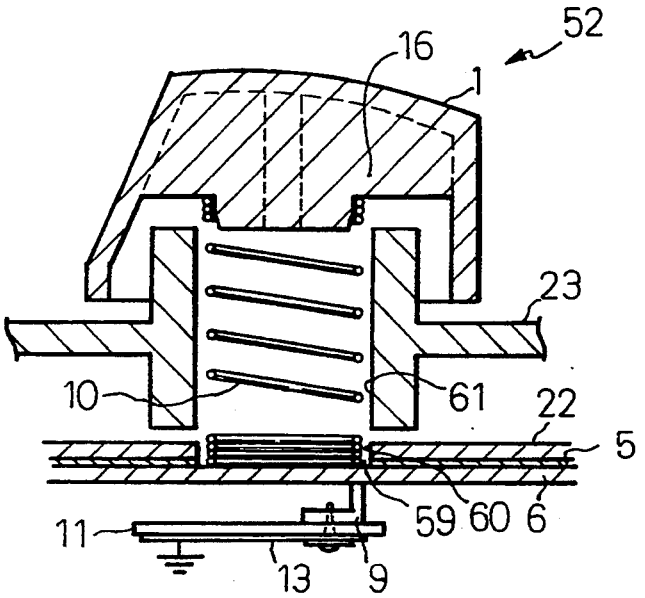
FIG. 10 is a cross-sectional view of a part of a keyboard according to the seventh embodiment of the present invention.

FIG. 10 in a cross-sectional view showing the seventh embodiment of the present invention, corresponding to FIG. 8. In FIG. 10, a projection 1*b* is formed on the lower surface of the keytop 1, and the coil spring 10 is fixed to the projection 1*b* by a press fit. By this arrangement, it is possible to increase the contact pressure between keytop 1 and the coil spring 10. Alternatively, it is possible to provide a depression on the lower surface of the keytop 1, instead of the projection 1*b*, to thereby fix the coil spring 10 to the depression of the keytop 1 by a press fit.

Figure 11:
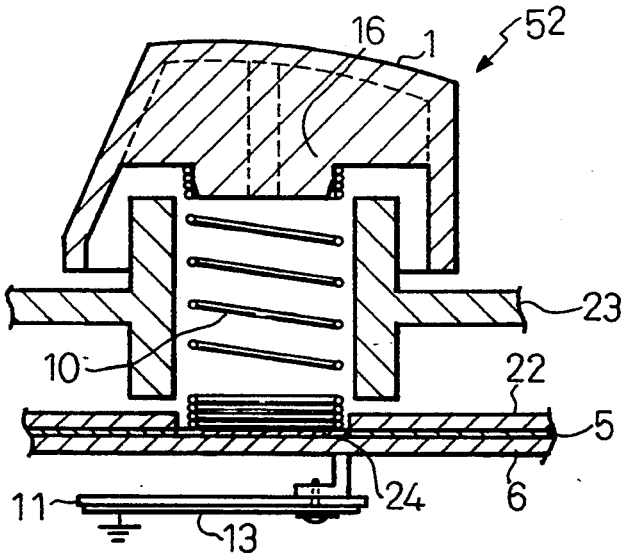
FIG. 11 is a cross-sectional view of a part of a keyboard according to the eighth embodiment of the present invention.

FIG. 11 is a cross-sectional view showing the eighth embodiment of the present invention, corresponding to FIG. 8. In FIG. 11, the coil spring 10 is fixed to the projection 1*b* of the keytop 1 by a press fit. Also, an electrically conductive rubber 24 is secured to the upper surface of the support panel 6 at position where the lower end of the coil spring 10 is located. This electrically conductive rubber 24 has a high resistance in the range from 10 to 500 MΩ and is arranged in place of the resistor 12 of FIG. 2.

In the arrangement of FIG. 2, the resistor 12 is located outside the support panel 6 and thus the support panel 6 is connected to the ground with a high resistance. Therefore, the electromagnetic shielding effect of the support panel 6 is reduced, and as in the arrangement of FIG. 11, if the electrically conductive rubber 24 is located inside the support panel 6, the electromagnetic shielding effect of the support panel 6 is not reduced.

Figure 12:
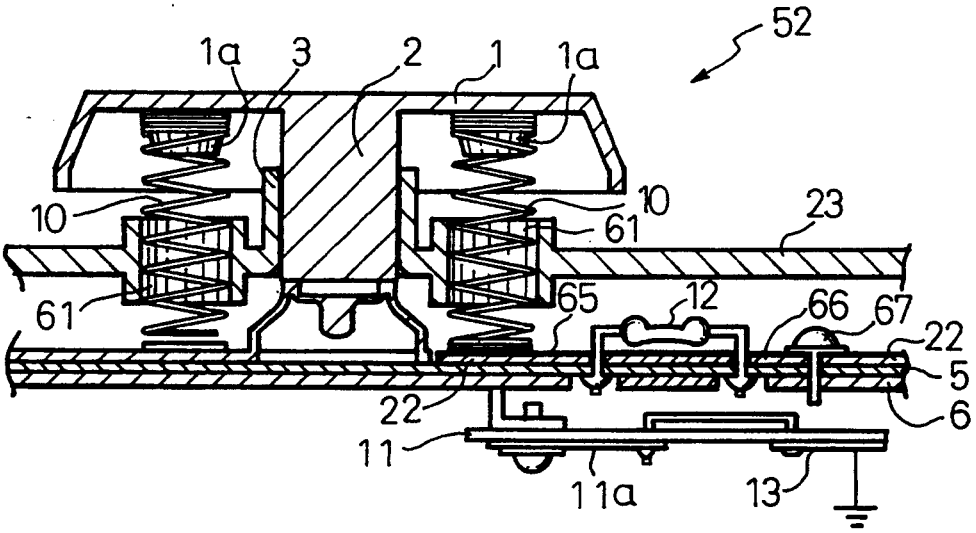
FIG. 12 is a cross-sectional view of a part of a keyboard according to the ninth embodiment of the present invention.

FIG. 12 shows the ninth embodiment of the present invention. It may be difficult for the electrically conductive rubber 24 of FIG. 11 to have an appropriate resistance value if it is thin. To overcome this problem, a resistor 12 is arranged inside the support panel 6 in FIG. 12.

In FIG. 12, the space key 52, similar to the embodiments of FIGS. 1 and 2, comprises the keytop 1, the slider 2 connected to the under side of the keytop 1, and the membrane switch 5. The membrane switch 5 is secured to the upper surface of the metal support panel 6, and the rubber actuator 22 and the switch panel 23 are arranged above the support panel 6. The housing 3 of the switch panel 23 slidably guides the slider 2.

In FIG. 12, two coil springs 10 are arranged on either side of the slider 2. However, there is no aperture in the membrane switch 5 and the rubber actuator 22 for passing the coil springs 10 therethrough, and apertures 61 are provided only in the switch panel 23. Accordingly, one of the respective ends of the coil springs 10 contacts the keytop 1 and the other respective ends of the coil springs 10 contact the rubber actuator 22.

A wiring 65 is provided on the rubber actuator 22 so that the lower end of the coil spring contacts the wiring 65. It is possible to place a metal plate instead of the wiring 65. A wiring 66 is provided on the rubber actuator 22 and spaced from the wiring 65. The resistor 12 is arranged between the wirings 65 and 66. The wiring 66 is connected to the support panel 6 via a metal pin 67 that extends through the rubber actuator 22 and the membrane switch 5. The support panel 6 is connected to the electrode 11*a* of the wiring circuit board 11 by the metal fitting 9 and the electrode 11*a* is connected to the ground electrode 13. In this way, a static electricity releasing circuit is formed from the keytop 1 to the ground via the coil springs 10, the wiring 65, the resistor 12, the wiring 66, the metal pin 67, and the support panel 6.

Figure 13:
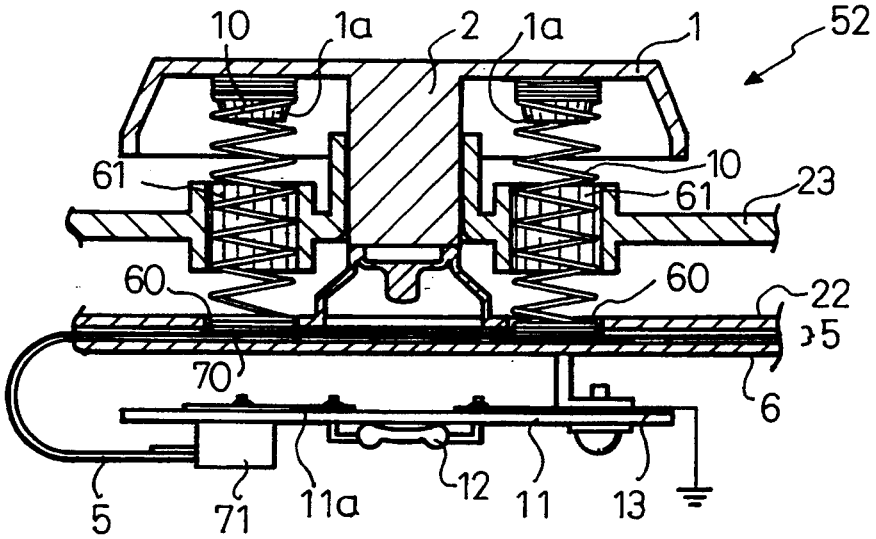
FIG. 13 is a cross-sectional view of a part of a keyboard according to the tenth embodiment of the present invention.

FIG. 13 shows the tenth embodiment of the present invention. In FIG. 13, a resistor 12 is arranged outside the support panel 6 but connected to the ground electrode 13 separately from the support panel 6.

In FIG. 13, two coil springs 10 are arranged on either side of the slider 2. However, there is no aperture in the membrane switch 5 for passing the coil springs 10 therethrough, and apertures 60 and 61 are provided only in the rubber actuator 22 and the switch panel 23, respectively. Accordingly, one of the respective ends of the coil springs 10 contacts the keytop 1 and the respective other ends of the coil springs 10 contact the membrane switch 5.

A wiring 70 is provided on the membrane switch 5 so that the lower end of the coil spring contacts the wiring 70. More specifically, referring to FIG. 4, the upper first resin layer 54 has apertures for passing the coil springs 10 therethrough, and the wiring 70 is provided on the lower second resin layer 56. The wiring 70 with the membrane switch 5 is connected to the electrode 11*a* of the wiring circuit board 11 by a connector 71 that also connects the other wirings of the membrane switch 5 to the other electrodes of the wiring circuit board 11. The electrode 11*a* connected to the wiring 70 is connected to the ground electrode 13 via a resistor 12. On the other hand, the support panel 6 is connected to the ground electrode 13 of the wiring circuit board 11 via the metal fitting 9. Accordingly, there is no resistor between the support panel 6 and the ground electrode 13, and the electromagnetic shielding effect of the support panel 6 is not reduced.

Figure 14:
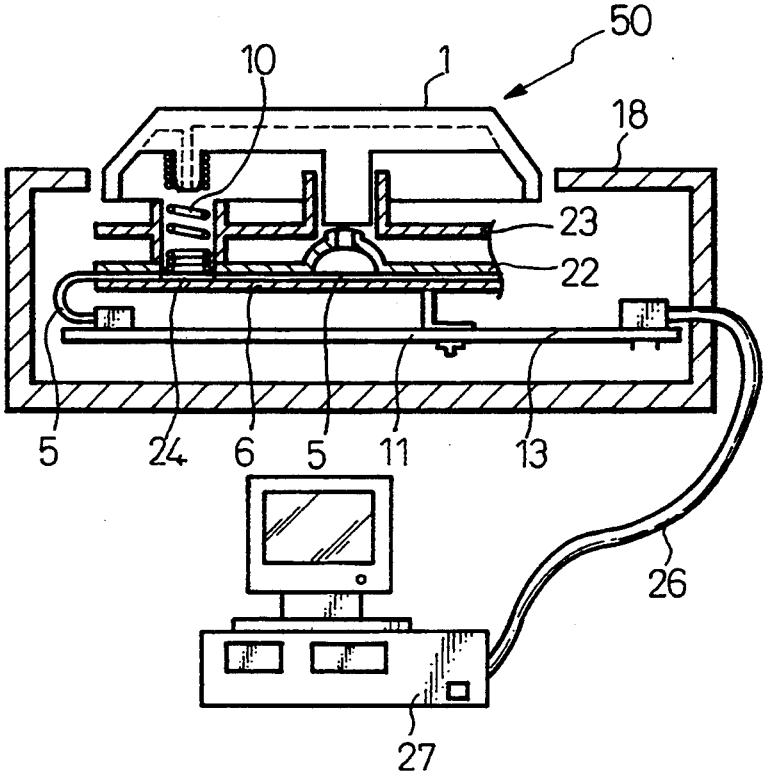
FIG. 14 is a cross-sectional view of a part of a keyboard according to the eleventh embodiment of the present invention.

FIG. 14 shows the eleventh embodiment of the present invention. In FIG. 14, the keyboard 50 having the above described key is connected to a computer 27 as a data processing apparatus. It will be apparent that the computer 27 has a ground electrode although it is not depicted. The ground electrode 13 of the keyboard 50 is connected to the ground electrode of the computer 27 and thus the keytop 1 is electrically connected to the ground of the data processing apparatus via the coil spring 10.

As explained, according to the present invention, it is possible to provide a data input device in which static electricity can be released to a ground in a reliably manner whereby the device is simple in construction.

We claim:

1. A data input device comprising a support panel and at least one key mounted on the support panel, said key comprising:

a switch element arranged on the support panel;

a manually operable keytop for turning the switch element on and off; and at least one coil spring biasing the keytop away from the support panel;

wherein at least a part of the keytop is made from an electrically conductive material, and the coil spring has one end brought into contact with at least a part of the keytop and the other end being connected to a ground.

2. A data input device according to claim 1, wherein at least a part of the keytop connected to a ground via the coil spring is made from metal.

3. A data input device according to claim 1, wherein said at least a part of the keytop connected to a ground via the coil spring is made from an electrically conductive plastic comprising a resin material and minute electrically conductive particles mixed in the resin material.

4. A data input device according to claim 3, wherein the entire keytop is made from the electrically conductive plastic.

5. A data input device according to claim 1, comprising a keyboard having character keys and at least one space key, at least a part of the keytop of the space key being made from an electrically conductive plastic and connected to a ground via the coil spring.

6. A data input device according to claim 5, wherein the space key comprises a slider connected to the keytop, a link interconnecting the keytop and the support panel for relative movement therebetween, and at least one coil spring biasing the keytop away from the support panel, said at least one coil spring comprising two coil springs arranged on either side of the slider, the support panel having a switch panel mounted thereto and having a housing for slidably guiding the slider.

7. A data input device according to claim 6, wherein the switch element comprises a membrane switch comprising a first layer having contacts, a second layer having contacts arranged correspondingly to the contacts of the first layer, and a spacer arranged between the first and second layers, the membrane switch being arranged between the switch panel and the support panel, the switch panel and the membrane switch having apertures for passing the coil springs therethrough, whereby one of the respective ends of the coil springs contacts the keytop and the other respective ends of the coil springs contact the support panel, the keytop being connected to a ground via the coil springs and the support panel.

8. A data input device according to claim 6, wherein the switch element comprises a membrane switch comprising a first layer having contacts, a second layer having contacts arranged correspondingly to the contacts of the first layer, and a spacer arranged between the first and second layers, the membrane switch being arranged between the switch panel and the support panel, the switch panel having apertures for passing the coil springs therethrough, the membrane switch having a wiring means connectable to a ground, whereby one of the respective ends of the coil springs contacts the keytop and the other respective ends of the coil springs contact the wiring means of the membrane switch, the keytop being connected to a ground via the coil springs and the wiring means of the membrane switch.

9. A data input device according to claim 1, wherein the data input key comprises a slider connected to the keytop, and at least one coil spring biasing the keytop away from the support panel, the support panel having a switch panel mounted thereon and having a housing for slidably guiding the slider.

10. A data input device according to claim 9, wherein the switch element comprises a membrane switch comprising a first layer having contacts, a second layer having contacts arranged correspondingly to the contacts of the first layer, and a spacer arranged between the first and second layers, the membrane switch being arranged between the switch panel and the support panel, the switch panel and the membrane switch having apertures for passing the coil springs therethrough, whereby one of the respective ends of the coil springs contacts the keytop and the other respective ends of the coil springs contact the support panel, the keytop being connected to a ground via the coil springs and the support panel.

11. A data input device according to claim 9, wherein the switch element comprises a membrane switch comprising a first layer having contacts, a second layer having contacts arranged correspondingly to the contacts of the first layer, and a spacer arranged between the first and second layers, the membrane switch being arranged between the switch panel and the support panel, the switch panel having apertures for passing the coil springs therethrough, the membrane switch having a wiring means connectable to a ground, whereby one of the respective ends of the coil springs contacts the keytop and the other respective ends of the coil springs contact the wiring means of the membrane switch, the keytop being connected to a ground via the coil springs and the wiring means of the membrane switch.

12. A data input device according to claim 1, wherein the keytop is made from an electrically conductive plastic material comprising a resin and minute electrically conductive particles, the electrically conductive plastic having a high resistance in the range from 10 to 500 MΩ.

13. A data input device according to claim 1, wherein the keytop is connected to a ground, via the coil spring and the support panel and is made from an electrically conductive plastic material comprising a resin and minute electrically conductive particles, the electrically conductive plastic having a resistance smaller than 1 MΩ, and a resistor having a high resistance in the range from 10 to 500 MΩ is arranged between the support panel and a ground.

14. A data input device according to claim 1, wherein the keytop is made from an electrically conductive plastic having a resistance smaller than 1 MΩ and is connected to a ground via the coil spring and the support panel, and a resistor having a high resistance in the range from 10 to 500 MΩ is arranged between the coil spring and the support panel.

15. A data input device according to claim 14, wherein the resistor comprises an electrically conductive rubber secured on the support panel.

16. A data input device according to claim 14, wherein a rubber actuator having a wiring means is arranged on the switch element, whereby one end of the coil spring contacts the keytop and the other end of the coil spring contacts the wiring means of the rubber actuator, and the resistor is arranged on the rubber actuator and has one end connected to the wiring means of the rubber actuator and the other end connected to the support panel.

17. A data input device according to claim 1, wherein the switch element comprises a membrane switch comprising a first layer having contacts, a second layer having contacts arranged correspondingly to the contacts of the first layer, and a spacer arranged between the first and second layers, the membrane switch having a wiring means connectable to a ground, whereby one end of the coil spring contacts the keytop and the other end of the coil spring contacts the wiring means of the membrane switch, the keytop being connected to a ground via the coil springs and the wiring means of the membrane switch, and wherein the keytop is made from an electrically conductive plastic having a resistance smaller than 1 MΩ, and a resistor having a high resistance in the range from 10 to 500 MΩ is arranged between the coil spring and the wiring means of the membrane switch.

18. A data input device according to claim 1, wherein the switch element comprises a membrane switch comprising a first layer having contacts, a second layer having contacts arranged correspondingly to the contacts of the first layer, and a spacer arranged between the first and second layers, the membrane switch having a wiring means, whereby one end of the coil spring contacts the keytop and the other end of the coil spring contacts the wiring means of the membrane switch, the keytop being connected to a ground via the coil springs, the wiring means of the membrane switch and the support panel, and wherein the keytop is made from an electrically conductive plastic having a resistance smaller than 1 MΩ, and a resistor having a high resistance in the range from 10 to 500 MΩ is arranged between the wiring means of the membrane switch and the support panel.

19. A data input device according to claim 1, comprising a wiring board, wherein the switch element comprises a membrane switch comprising a first layer having contacts, a second layer having contacts arranged correspondingly to the contacts of the first layer, and a spacer arranged between the first and second layers, the membrane switch having a wiring means, whereby one end of the coil spring contacts the keytop and the other end of the coil spring contacts the wiring means of the membrane switch, the keytop being connected to a ground via the coil springs, the wiring means of the membrane switch and the wiring board, and wherein the keytop is made from an electrically conductive plastic having a resistance smaller than 1 MΩ, and a resistor having a high resistance in the range from 10 to 500 MΩ is arranged between the wiring means of the membrane switch and the wiring board.

20. A data input device according to claim 1, wherein a metal element is arranged between the keytop and the coil spring so that a contact area between the metal element and the keytop is broader than a contact area between the metal element and the coil spring.

21. A data input device according to claim 1, wherein the coil spring is fixed to the keytop by a press fit.

22. A data input device according to claim 1, wherein said data input device is connected to a data processing apparatus having a ground, and the keytop is electrically connected to the ground of the data processing apparatus via the coil spring.

23. A data input device comprising a support panel and at least one key mounted on the support panel, said key comprising;

a switch element arranged on the support panel;

a manually operable keytop for turning the switch element on and off; and at least one coil spring biasing the keytop away from the support panel;

wherein at least a part of the keytop is made from an electrically conductive plastic comprising a resin material and minute electrically conductive particles mixed in the resin material, and the coil spring has one end brought into contact with at least a part of the keytop and the other end being connected to a ground.

* * * * *